United States Patent [19]

Knox

[11] 4,315,645

[45] Feb. 16, 1982

[54] RUG HOOKING STAND

[76] Inventor: Billy B. Knox, 306 Labian Dr., Flushing, Mich. 48433

[21] Appl. No.: 101,911

[22] Filed: Dec. 10, 1979

[51] Int. Cl.[3] ..... D04G 3/02

[52] U.S. Cl. ..... 289/18.1; 38/102.4; 38/102.91

[58] Field of Search ..... 289/18.1; 223/106; 38/102.4, 102.91

[56] References Cited

U.S. PATENT DOCUMENTS

| | | | |
|---|---|---|---|
| 544,182 | 8/1895 | Lincoln | 223/106 |
| 1,479,170 | 1/1924 | Caspary | 223/106 |
| 1,910,934 | 5/1933 | Segal | 38/102.4 X |
| 2,555,896 | 6/1951 | Morse | 289/18.1 |
| 2,802,254 | 8/1957 | Valva | 289/18.1 |
| 3,098,280 | 7/1963 | Harris et al. | 38/102.4 |
| 3,774,326 | 11/1973 | Selden | 38/102.4 |
| 3,955,722 | 5/1976 | Bard | 223/106 |

FOREIGN PATENT DOCUMENTS

| | | | |
|---|---|---|---|
| 2752273 | 5/1979 | Fed. Rep. of Germany | 289/18.1 |
| 868254 | 5/1961 | United Kingdom | 289/18.1 |

*Primary Examiner*—Louis Rimrodt

*Attorney, Agent, or Firm*—Gifford, VanOphem, Sheridan & Sprinkle

[57] ABSTRACT

A novel stand is provided for holding a hooked rug in order to facilitate the construction of the hooked rug. The stand comprises a pair of upright supports which extend generally vertically and in a spaced apart relationship relative to each other. A first elongated roller is disposed in between the upright supports near their upper end. A second elongated roller is also disclosed in between the upright supports at a position spaced downwardly from the upper roller and so the axes of both rollers are substantially parallel with each other. The free ends of a V-shaped strut are secured to each upright support so that each strut extends laterally outwardly from its respective upright support while an elongated rod is supported between the joined ends of the struts so that the rod is parallel to and laterally spaced away from the rollers. A plurality of hooks are secured to each of the rollers and the hooks on one roller engage one edge of a pattern for the hooked rug while, similarly, the hooks on the other roller engage the opposite edge of the hooked rug pattern. Moreover, the hooked rug pattern is positioned partially around the rod so that a portion of the pattern is disposed between the upper roller and the rod at a position which is accessible to the person constructing the hooked rug in order to facilitate the hooked rug construction. Moreover, both of the rollers are rotatably mounted to the upright supports so that as the hooked rug is constructed, it can be coiled around the lower roller which simultaneously positions an unhooked portion of the hooked rug pattern in between the upper roller and the rod. The rollers, moreover, can be locked at any desired rotational position.

7 Claims, 4 Drawing Figures

RUG HOOKING STAND

BACKGROUND OF THE INVENTION

I. Field of the Invention

The present invention relates generally to stands and, more particularly, to a stand to facilitate the construction of a hooked rug.

II. Description of the Prior Art

The construction of hooked rugs is rapidly becoming a favorite pastime of many persons. In order to construct a hooked rug, a hooked rug pattern is first purchased which consists of a pattern of crisscrossing interlaced cords or strings thus forming a plurality of square openings in the pattern. The pattern can also include a colored design indicative of the color of the yarn which is to be secured to that portion of the pattern.

In the actual construction of the hooked rug, a hooked rug needle is employed to tie relatively short pieces of yarn to the hooked rug pattern in a knot so that one or more pieces of yarn are secured around each of the square openings. Moreover, the square openings in the hooked rug pattern permit the insertion of the hooked rug needle through the pattern with an attached piece of yarn so that, upon withdrawing the needle from the pattern, the piece of yarn is tied around one of the crisscrossing cords which form the hooked rug pattern. In constructing the hooked rug, typically an area of the pattern is completely filled with the yarn and, thereafter, the person constructing the hooked rug moves to another area on the hooked rug pattern and the process is repeated.

In actually constructing the hooked rug, it has been the previous practice to fold the hooked rug pattern over upon itself a number of times so that a relatively small area of the pattern is exposed. The folded pattern is then positioned on the lap of the person making the hooked rug and the construction of the hooked rug proceeds in the above-described fashion.

This previously known method of folding the pattern and placing it on one's lap, however, is disadvantageous in a number of different respects. One problem with supporting the hooked rug pattern in this fashion is that the hooked rug needle is oftentimes inadvertently inserted through two layers, rather than only one layer, of the hooked rug pattern. Thus, when the needle is withdrawn, the yarn is tied into a knot around two layers of the hooked rug pattern and the pattern is undesirably fastened to itself. This, of course, necessitates the removal of the knot which has been tied around two layers of the pattern.

A still further disadvantage of folding the hooked rug pattern upon itself and then supporting it on one's lap is that once the exposed portion of the hooked rug pattern is completed, the hooked rug pattern must be unfolded and refolded in a different fashion in order to expose the next section of the pattern. This process is time consuming and oftentimes difficult, particularly when the hooked rug pattern is large in size.

SUMMARY OF THE PRESENT INVENTION

The present invention overcomes the above mentioned difficulties in constructing hooked rugs by providing a novel stand designed to hold a hooked rug pattern in a position which facilitates the construction of the hooked rug and in which different portions of the hooked rug pattern can be simply and easily exposed.

In brief, the present invention comprises a pair of upright supports which extend generally vertically and are spaced apart and parallel with respect to each other. A first elongated roller is disposed between and supported by the upright supports near their upper ends.

A second elongated roller is also secured to and between the upright supports at a position beneath the first roller. The axes of the first and second rollers are parallel to each other and extend horizontally.

The free ends of a V-shaped strut are secured to each upright support so that the strut extends laterally outwardly from the upright support and so that the joined end of each strut is laterally spaced from the rollers. An elongated rod is then positioned between and supported by the joined ends of the struts so that the rod is parallel to but laterally spaced from the rollers.

A plurality of axially spaced hooks are secured to each roller in any conventional fashion. One edge of the hooked rug pattern is then attached to the hooks on one of the rollers, the hooked rug pattern is draped over the rod and the opposite edge of the hooked rug pattern is attached to the hooks on the second roller. In this fashion, a portion of the hooked rug pattern is positioned in between the first or upper roller and the rod and thus at a position easily accessible to the person constructing the hooked rug.

Both the first and second rollers are rotatably mounted to the upright supports so that the hooked rug pattern and/or the constructed hooked rug can be coiled around either or both of the rollers by simply, manually rotating the rollers. Moreover, when the portion of the hooked rug pattern between the first roller and the rod has been completed, the adjacent unhooked area of the hooked rug pattern can be conveniently positioned in between the upper roller and the rod by merely rotating the lower roller and thus coiling the completed hooked rug around it. At least one wing nut is associated with each roller to lock the rollers at any desired rotational position.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
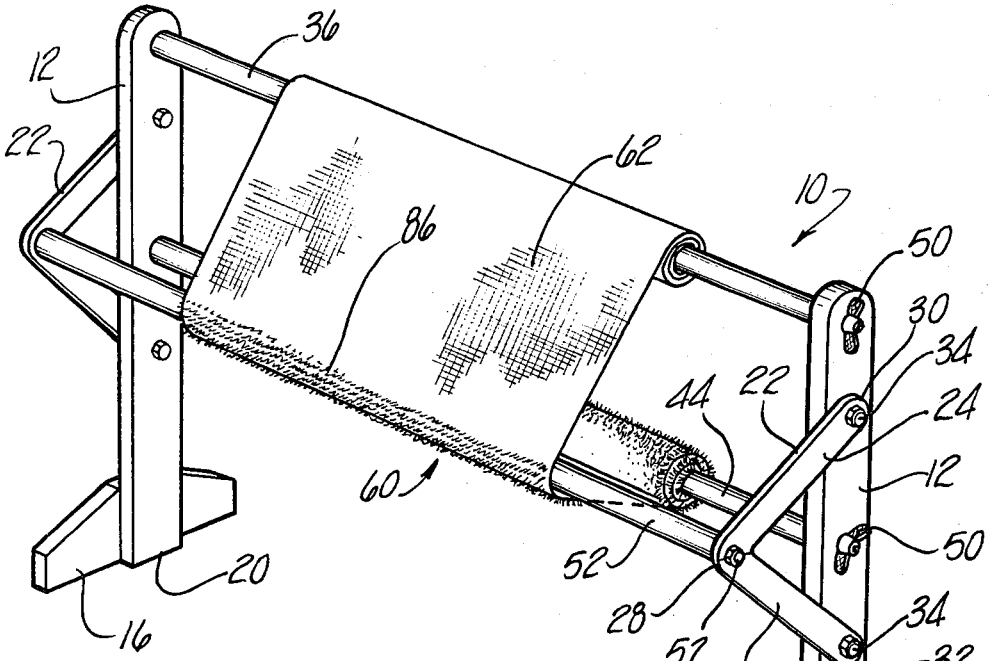
FIG. 1 is a perspective view of the rug hooking stand of my invention.
Figure 2:
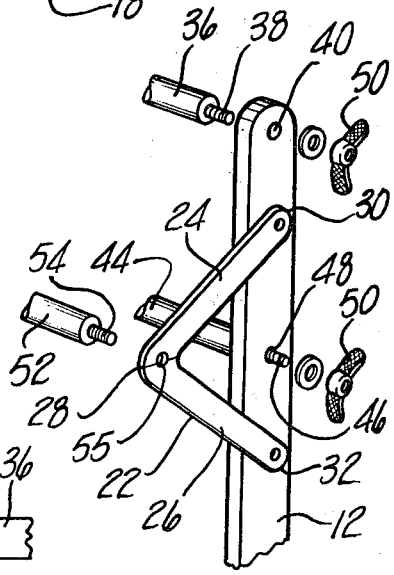
FIG. 2 is a fragmentary exploded view showing a portion of the rug hooking stand of my invention.

With reference first to FIGS. 1 and 2, the rug hooking stand 10 according to the present invention is thereshown and comprises a pair of substantially identical upright supports 12 which are spaced apart and generally parallel to each other. A laterally extending base 16 secured to the lower end of each upright support 12 by bolts 17 so that the lower edge 18 of the base 16 is flush with the bottom 20 and the upright support 12.

Still referring to FIGS. 1 and 2, the stand comprises a V-shaped strut 22 having a first leg 24 and a second leg 26 and in which one end 28 of the legs 24 and 26 are secured together by a lapped joint as best shown in FIG. 2. The free ends 30 and 32 of the strut legs 24 and 26 respectively, are secured to each upright support 12 by any suitable means, such as bolts 34 and the ends 30 and 32 of the strut legs 24 and 26 are vertically aligned with each other. Moreover, as is best shown in FIG. 1, with the strut 22 secured to the upright support 12, the strut 22 extends laterally outwardly from the upright support 12.

Still referring to FIGS. 1 and 2, the stand 10 further comprises an elongated cylindrical roller 36 having a threaded stud 38 extending coaxially outwardly from each end of the roller 36. The roller 36 is positioned in between the upright supports 12 so that each stud 38 is positioned through an aperture 40 formed through the upper end of the upright support 12. Moreover, each stud 38 is sufficiently long so that it extends entirely through the upright support 12 and protrudes outwardly from its other side.

The stand 10 further comprises a second elongated roller 44 which is substantially identical in construction with the first roller 36 and thus includes the studs 46 extending coaxially outwardly from each end of the roller 44. These studs 46 are positioned through apertures 48 in the upright supports 12 so that the second roller 44 is parallel to but spaced downwardly from the first roller 36. The rollers 44 and 36 are secured to the supports 12 by wing nuts 50 which engage the studs 38 and 46.

The stand 10 further includes an elongated rod 52 which also has a stud 54 extending coaxially outwardly from each end of the rod 52. Each stud 54 is positioned through an aperture 55 at the joined end 28 of one of the struts 22 and is secured to the struts 22 by nuts 57. Moreover, the rod 52 is parallel to the rollers 36 and 44 and positioned vertically in between and spaced laterally outwardly from the rollers 36 and 44. The rollers 36 and 44 and the rod 52 are all substantially equal in length.

Figure 3:
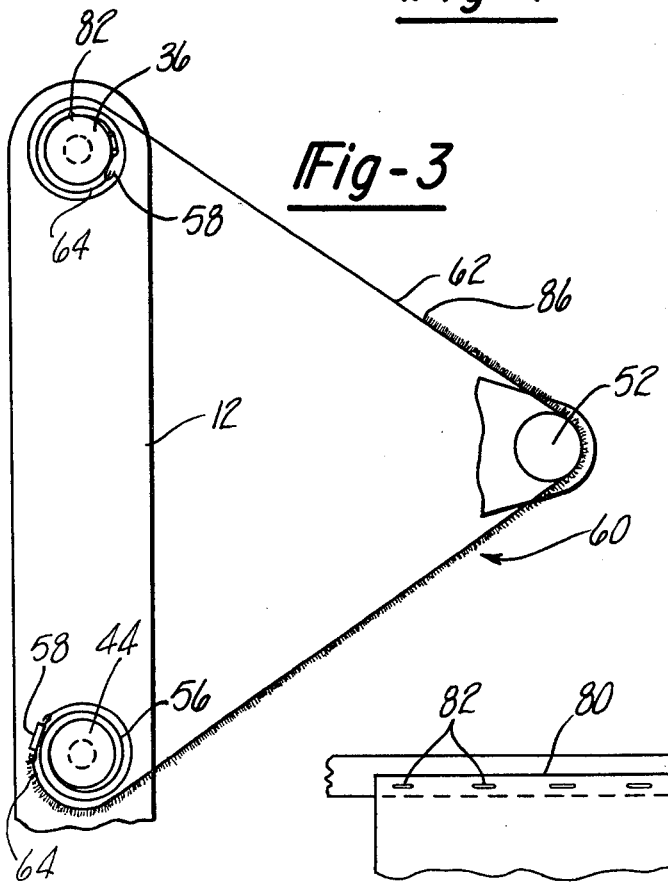
FIG. 3 is a fragmentary sectional view illustrating the operation of the rug hooking stand of my invention.
Figure 4:
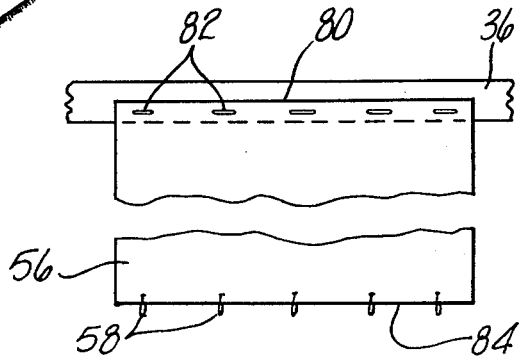
FIG. 4 is a fragmentary plan view showing a portion of the rug hooking stand of my invention.

Referring now to FIGS. 3 and 4, an elongated flexible sheet 56 is secured along one longitudinal edge 80 to the first roller 36 by staples 82 while, similarly, one longitudinal edge of a like sheet 56 is secured to the second roller 44. A plurality of hooks 58 are attached along the opposite longitudinal edge 84 of each sheet 56 so that the hooks 58 are longitudinally spaced from each other along each sheet 56.

With reference now to FIGS. 1 and 3, the stand 10 according to the present invention is designed to facilitate the construction of a hooked rug 60 having a hooked rug pattern 62 constructed of crisscrossing fibers in the conventional fashion. One edge 64 of the pattern 62 is positioned over the hooks 58 on the upper roller 36 and the pattern is then draped over the rod 52 so that a portion of the pattern is exposed between the rod 52 and the upper roller 36. The opposite edge 66 of the pattern is then secured to the hooks 58 on the lower roller 44.

Since the rollers 36 and 44 are secured to the upright supports 12 by the wing nuts, either or both of the rollers 36 and 44 can be simply manually rotated by loosening the wing nut and thereafter rotating the roller. Consequently, with the pattern 62 secured to the rollers 36 and 44 in the previously described fashion, the wing nuts securing the upper roller 36 to the upright supports are loosened and the roller 36 is then rotated thus coiling the excess hooked rug pattern 62 around the upper roller 36 and so that the lower edge of the pattern is positioned just above the rod 52. When the pattern is taut, the wing nuts on the upper roller 36 are again tightened thus securing the hooked rug pattern into position.

The stand 10 of the present invention thus conveniently exposes a portion of the hooked rug pattern 62 between the rod 52 and the upper roller 36. Moreover, since the lower roller 44 is spaced upwardly from the ground, a person constructing the hooked rug can conveniently sit in front of the rod 52 with his or her legs positioned underneath the hooked rug pattern 62 extending between the rod 52 and the lower roller 44.

When the portion of the hooked rug pattern 62 between the rod 52 and the upper roller 36 has been constructed, a new or unhooked portion of the pattern can then be easily positioned in between the rod 52 and upper roller 36 by merely loosening the wing nuts securing the rollers 44 and 36 to the upright supports 12 and thereafter rolling the completed portion of the rug onto and around the lower roller 44 as shown in FIG. 3. When the pattern 62 is positioned as desired, the wing nuts 50 are again tightened thus securing the bars 36 and 44 in place. In this fashion, the top edge 86 (FIGS. 1 and 3) of the completed portion of the hooked rug 60 is always conveniently positioned above the rod 52.

From the foregoing, it can be seen that the rug hooking stand 10 according to the present invention provides a simple, inexpensive and yet unique stand which facilitates the construction of a hooked rug. The previously known method of folding the hooked rug in order to expose the desired portion of the pattern is completely avoided and, likewise, the previously known problem of inadvertently inserting the hooked rug needles through two layers of the pattern is entirely avoided.

Having described my invention, however, many modifications thereto will become apparent to those skilled in the art to which it pertains without deviation from the spirit of the invention as defined by the scope of the appended claims.

I claim:

1. A stand for holding an elongated pattern sheet having opposing edges, said stand comprising:

a pair of spaced and vertically extending upright supports each upright support having one end adapted to be supported by a ground surface;

a first elongated roller disposed between and rotatably secured to said upright supports;

a second elongated roller disposed between and rotatably secured to said upright supports so that said second roller is substantially parallel to said first roller and at a position spaced downwardly from said first roller, said second roller being positioned upwardly from said one ends of said upright supports;

an elongated rod secured to said upright supports so that said rod is substantially parallel to said rollers and at a position spaced laterally forwardly from both said first and second rollers;

means for detachably securing one edge of said pattern sheet to the other roller so that said sheet extends over and partially around said rod;

manually operated means for locking said first roller against rotation at an infinitely variably selected rotational position of the first roller;

manually operated means for locking said second roller against rotation at an infinitely variably selected rotational position of the second roller;

wherein one roller forms a supply roller around which the pattern sheet is adapted to be coiled while the other roller forms a takeup roller around which the pattern sheet is adapted to be coiled; and wherein said elongated rod and said second roller are spaced upwardly from said one end of said upright supports so that said pattern sheet extending between said rod and said second roller is spaced above the ground surface by an amount greater than a normal knee height of a seated person wherein each detachable securing means comprises a flexible attachment sheet fixedly secured along one edge to its respective roller and having a plurality of hooks secured to its opposite edge for engaging an edge of the pattern sheet, and wherein each attachment sheet has a width between its edges to enable said attachment sheet to be coiled around its respective roller.

2. The invention as defined in claim 1 wherein said pattern sheet is coiled around at least one of said first or second rollers so that, upon rotation of either said first or second roller, a different portion of the pattern sheet is positioned between said rod and said first roller.

3. The invention as defined in claim 1 and further comprising a pair of struts, each strut being secured at one end to one of said upright supports so that each strut extends laterally outwardly from its respective upright support, said rod being disposed between and supported by the other ends of the struts.

4. The invention as defined in claim 6 wherein each strut is V-shaped having its free ends secured to its respective upright support and in which each end of the rod is secured to the apex of one of the struts.

5. The invention as defined in claim 1 wherein the pattern sheet is a hooked rug pattern.

6. The invention as defined in claim 1 wherein said rollers each includes a threaded stud extending axially outwardly from each end of each roller, said studs extending through apertures formed in said upright supports and wherein said locking means comprises nuts which threadably engage said studs and, upon tightening, secure their associated roller against rotation.

7. The invention as defined in claim 6 wherein said nuts are wing nuts.

* * * * *